US007938675B1

(12) United States Patent
Yu et al.

(10) Patent No.: US 7,938,675 B1
(45) Date of Patent: May 10, 2011

(54) ELECTRICAL CONNECTOR AND ELECTRICAL CONNECTOR ASSEMBLY HAVING HEAT-RADIATING STRUCTURES

(75) Inventors: Wang-I Yu, Jhonghe (TW); Shu-Yi Chiu, Jhonghe (TW); Hung-Chi Tai, Jhonghe (TW)

(73) Assignee: Alltop Electronics (Suzhou) Co., Ltd, Taicang, Jiangsu Province (CN)

( * ) Notice: Subject to any disclaimer, the term of this patent is extended or adjusted under 35 U.S.C. 154(b) by 0 days.

(21) Appl. No.: 12/832,526

(22) Filed: Jul. 8, 2010

(30) Foreign Application Priority Data

Mar. 11, 2010 (CN) ..... 2010 1 0147600

(51) Int. Cl.
*H01R 13/00* (2006.01)

(52) U.S. Cl. ..... 439/485

(58) Field of Classification Search ..... 439/485, 439/206

See application file for complete search history.

(56) References Cited

U.S. PATENT DOCUMENTS

| | | | | |
|---|---|---|---|---|
| 7,275,966 | B2 * | 10/2007 | Poh et al. | 439/485 |
| 7,486,516 | B2 * | 2/2009 | Colbert et al. | 361/710 |
| 7,597,573 | B2 * | 10/2009 | Defibaugh et al. | 439/290 |
| 7,666,025 | B2 * | 2/2010 | Cheng et al. | 439/485 |
| 7,690,937 | B2 * | 4/2010 | Daily et al. | 439/290 |
| 2007/0293084 | A1 * | 12/2007 | Ngo | 439/552 |
| 2010/0273347 | A1 * | 10/2010 | Tai et al. | 439/485 |

FOREIGN PATENT DOCUMENTS

CN 2840359 Y 11/2006

* cited by examiner

*Primary Examiner* — Briggitte R Hammond
(74) *Attorney, Agent, or Firm* — Sughrue Mion, PLLC

(57) ABSTRACT

An electrical connector in accordance with the present invention includes an insulative housing defining a mating direction and at least one contact-receiving passage extending along the mating direction, and at lest one conductive contact received in the contact-receiving passage. Each conductive contact includes a mating section, a retaining section extending from the mating section and interferentially retained in the contact-receiving passage, and a mounting section extending from the retaining section. The insulative housing defines at least one heat-radiating passage penetrating through the insulative housing along the mating direction and communicating with the contact-receiving passage.

20 Claims, 7 Drawing Sheets

ELECTRICAL CONNECTOR AND ELECTRICAL CONNECTOR ASSEMBLY HAVING HEAT-RADIATING STRUCTURES

BACKGROUND OF THE INVENTION

1. Field of the Invention

The present invention relates to an electrical connector and an electrical connector assembly, more particularly to an electrical connector and an electrical connector assembly having heat-radiating structures.

2. Description of Related Art

Electrical connectors are widely used today. In general, electrical connectors can be classified as desktop connectors, laptop connectors, mobile phone connectors, consuming connectors, and other types. Power connector is one common kind electrical connector used in different equipments. Usually, a plug-type power connector and a receptacle-type power connector mate with each other to supply power to equipments. Contacts of the plug and the receptacle contact one another to form electrical connection. However, because of impedance of conductors, that is contacts, heat is generated and is not easy to be radiated out of the connectors. If the heat cannot be radiated out of the connectors in time, the heat accumulated in the connectors may cause different problems. For example, contacting portions of the contacts may produce carbon, melt, and excessive deformation etc. The insulative housing also may produce deformation, melt etc. Such phenomenon all can produce influence to reliability of power transmission and use life of the power connectors. For ensuring stability of power supply, sometimes, customers use monitor equipments to monitor product temperature when the power connectors work. Under such sustaining heat, the monitor equipment is prone to being out of use.

Please refer to FIGS. 1-3, a conventional receptacle connector 1' and a conventional plug connector 2' are disclosed. The receptacle connector 1' comprises an elongate first insulative housing 2' and a plurality of first conductive contacts 3' received in the first insulative housing 2' and classified into three different sizes. The plug connector 2' comprises an elongate second insulative housing 5' and a plurality of second conductive contacts 6' received in the second insulative housing 5' and classified into three different sizes corresponding to the first conductive contacts 3'. Mating portions 61' of the second conductive contacts 6 are exposed into a receiving space 50' of the second insulative housing 5' to form electrical connection with the first conductive contacts 3'. As illustrated in FIG. 3, when electrical connection is formed between the first and second conductive contacts 3', 6', heat is generated. However, there is no enough space between the mated first and second insulative housings 2', 5' for heat radiation, and the first and second conductive contacts 3', 6' are retained in the first and second insulative housings 2', 5' tightly. A lot of heat thus gets together in the first and second insulative housings 2', 5', all kinds of undesired phenomenon will occur to influence the reliability of power supply and use life of the connectors.

China Patent CN 2840359Y disclosed an electrical connector with improved structures for better heat radiation effect. An insulative housing of the electrical connector defines a pair of through holes at opposite ends thereof for heat radiation. However, only these two through holes cannot solve the problem mentioned above thoroughly. Hence, it is disable to design an electrical connector to address problems mentioned above.

BRIEF SUMMARY OF THE INVENTION

Accordingly, an object of the present invention is to provide an electrical connector with improved heat-radiating structures.

Another object of the present invention is to provide an electrical connector assembly with improved heat-radiating structures.

In order to achieve the above-mentioned object, an electrical connector adapted for electrically connecting with a complementary connector comprises an insulative housing, at least one conductive contact received in the insulative housing. The insulative housing defines a mating direction, at least one contact-receiving passage extending along the mating direction, and at least one heat-radiating passage penetrating therethrough and communicating with said at least one contact-receiving passage. The at least one conductive contact is received in the at least one contact-receiving passage adapted for electrically connecting with conductive contact of the complementary connector and generating heat. The at least one conductive contact comprises a mating section adapted for electrically connecting with corresponding conductive contact of the complementary connector, a retaining section extending from the mating section and interferentially engaged with the at least one contact-receiving passage, and a mounting section extending from the retaining section. The heat generated by the conductive contacts is capable of radiated out of the insulative housing through the at least one heat-radiating passage.

In order to achieve the above-mentioned object, an electrical connector assembly comprises a first connector defining a mating direction and a second connector electrically connecting with the first connector. The first connector comprises a first insulative housing defining at least one first contact-receiving passage penetrating therethrough along the mating direction; and at least one first conductive contact received in the at least one first contact-receiving passage of the first insulative housing. The second connector comprises a second insulative housing defining at least one second contact-receiving passage penetrating therethrough along the mating direction, and at least one second conductive contact received in the at least one second contact-receiving passage of the second insulative housing and electrically connecting with the at least one first conducive contact. At least one heat-radiating passage penetrates through at least one of the first insulative housing and the second insulative housing along the mating direction and communicates with at least one of the at least one first contact-receiving passage and the at least one second contact-receiving passage. The heat generated by the first and second conductive contacts is capable of being radiated out of the first and second insulative housings via flowing through the at least one heat-radiating passage.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
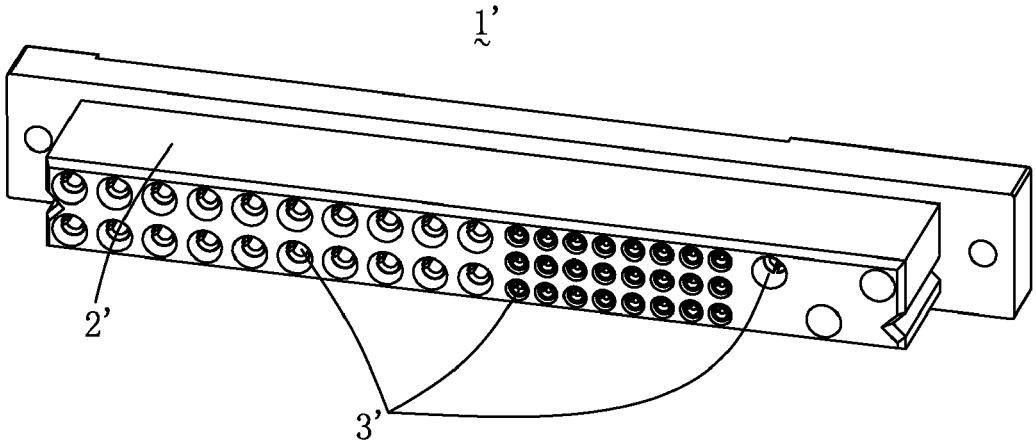
FIG. 1 (Prior Art)
FIG. 1 is an assembled, perspective view of a conventional receptacle connector.
Figure 2:
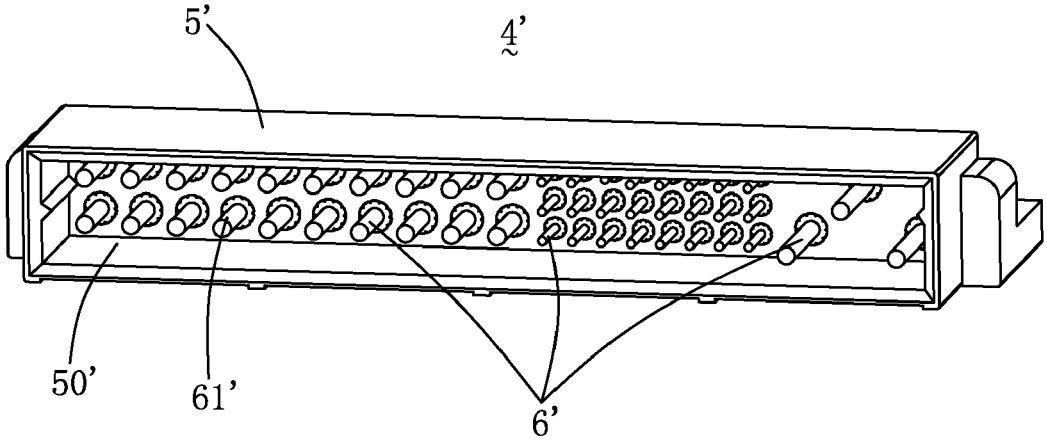
FIG. 2 (Prior art)
FIG. 2 is an assembled, perspective view of a conventional plug connector.
Figure 3:
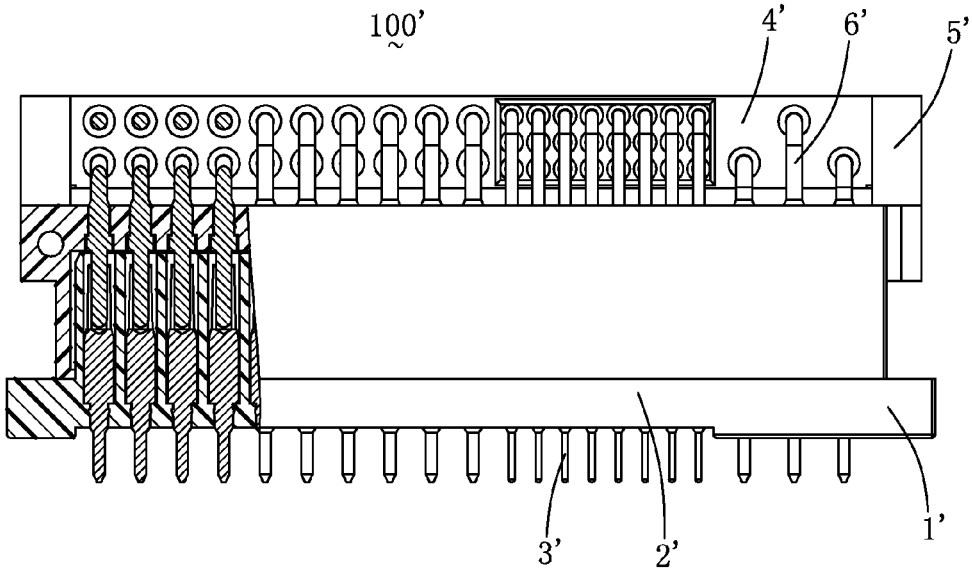
FIG. 3 (Prior Art)
FIG. 3 is a partially cross-sectional view of an electrical connector assembly formed by the conventional receptacle connector and plug connector shown in FIGS. 1 and 2.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 4:
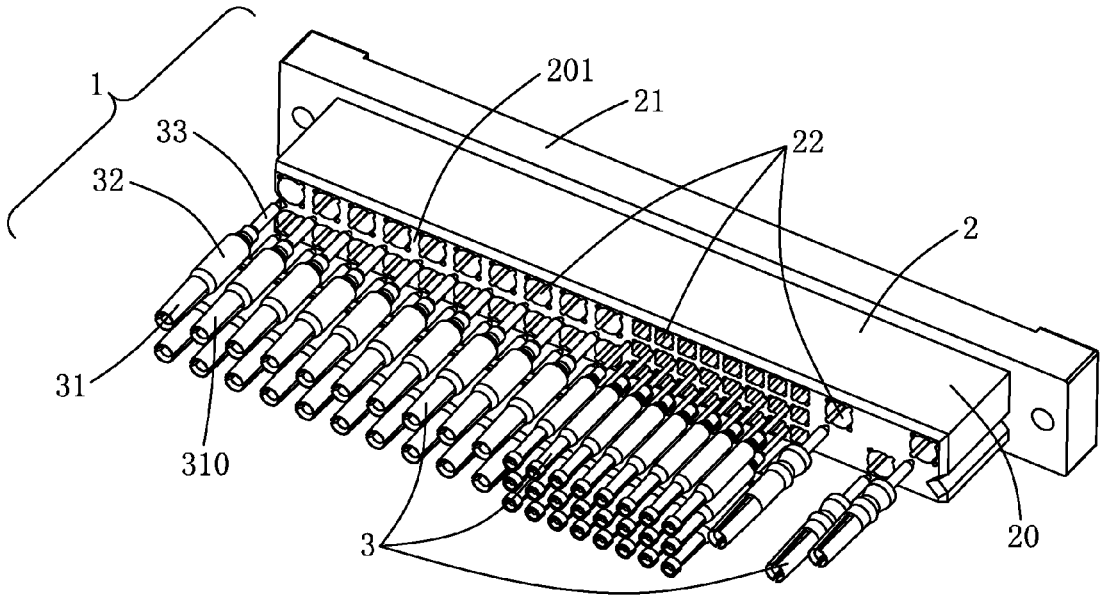
FIG. 4 is an exploded, perspective view of a first connector (electrical connector) in accordance with the present invention.
Figure 5:
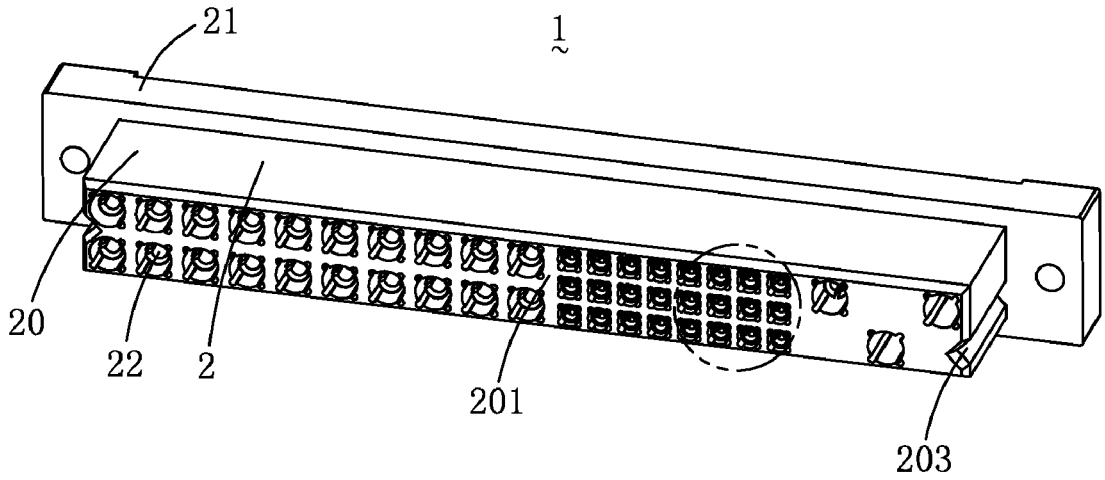
FIG. 5 is an assembled, perspective view of the first connector of FIG. 4.
Figure 6:
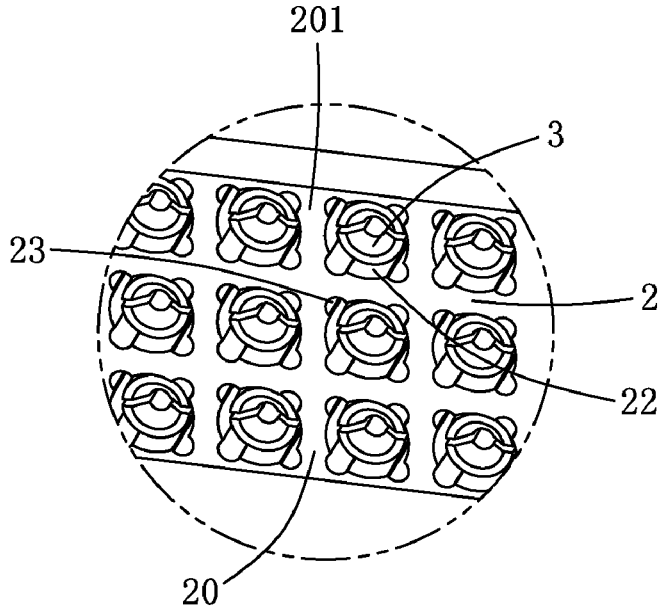
FIG. 6 is an enlarged view of a circled part shown in FIG. 5.
Figure 7:
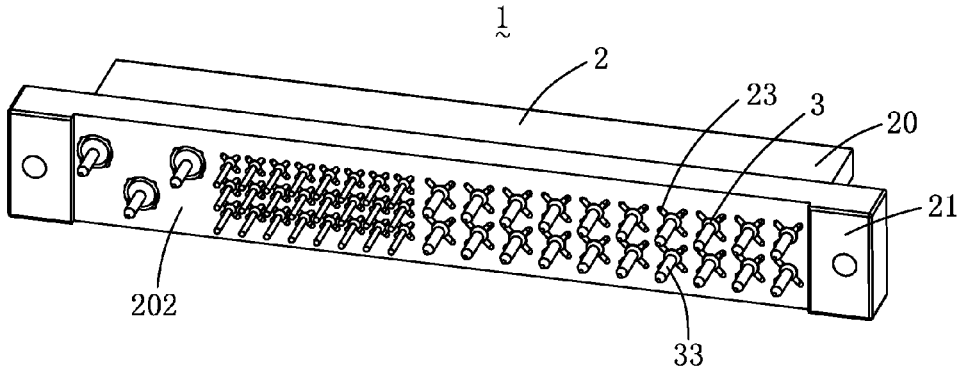
FIG. 7 is a rear assembled, perspective view of the first connector.

Referring to FIGS. 4-7, a first connector 1 in accordance with a preferred embodiment of the present invention is shown. In the preferred embodiment, the first connector 1 is a receptacle connector. As shown in FIG. 4, the first connector 1 comprises an elongate first insulative housing 2 and a plurality of first conductive contacts 3 assembled in the first insulative housing 2. In the preferred embodiment, the first conductive contacts 3 are classified into three groups with different sizes for different kinds of signal transmission.

In the preferred embodiment, the first insulative housing 2 defines a front face 201 and a rear face 202 opposite to the front face 201, and a mating direction extending along front-to-back direction. The first insulative housing 2 comprises a rectangular first base portion 21 and a rectangular mating portion 20 extending forwardly from middle of a front surface of the first base portion 21, and a plurality of first contact-receiving passages 22 penetrating through the first base portion 21 and the mating portion 20. Each sidewall of the mating portion 20 defines a V-shape aligning slot 203 recessed inwardly from outer surface thereof. The aligning slots 203 extend along the mating direction and locate at different heights of the mating portion 20. The first insulative housing 2 is divided into three sections. From left to right direction, the first section of the first insulative housing 2 defines a plurality of first contact-receiving passages 22 aligned in upper and lower rows. The middle section defines a plurality of first contact-receiving passages 22 aligned in three rows. The right section of the first insulative housing 2 defines three first contact-receiving passages 22 arranged in triangle relationship.

Each first contact-receiving passage 22 defines two pairs of arc-shape first heat-radiating passages 23 which communicate with the first contact-receiving passage 22. The first heat-radiating passages 23 penetrate through the first insulative housing 2 along the mating direction, that is, from the front face 201 to the rear face 202. The first heat-radiating passages 23 are recessed outwardly from inner circumferential surface of the first contact-receiving passage 22 and arranged symmetrically relative to the first contact-receiving passage 22 for radiating heat evenly. In a surface perpendicular to the mating direction, such as in the front face 201 or in the rear face 202, the imaginary lines from each first heat-radiating passage 23 to a center point of the first contact-receiving passage 22 consist a crisscross shape (referring to FIGS. 6-7). Of course, in alternative embodiments, at least one first heat-radiating passage 23 also can realize the purpose of the present invention, and the shape of each first heat-radiating passage 23 is also not restricted only to the arc shape.

Figure 8:
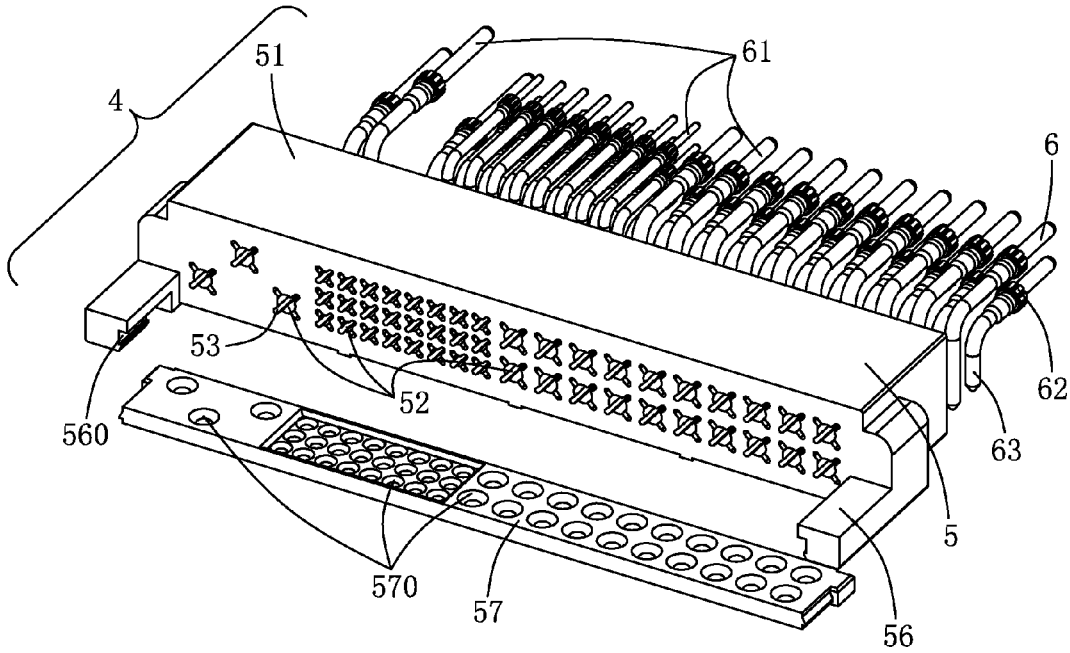
FIG. 8 is a rear exploded, perspective view of a second connector (electrical connector) in accordance with the present invention.
Figure 9:
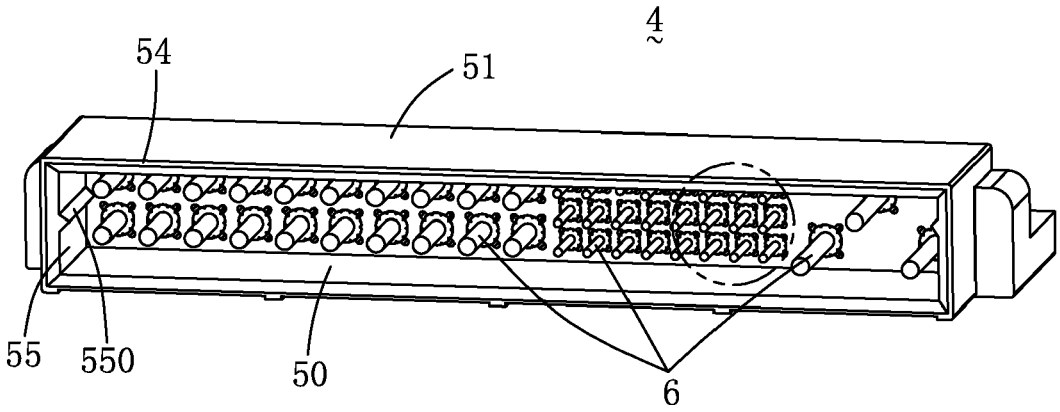
FIG. 9 is a front assembled, perspective view of the second connector of the present invention.
Figure 10:
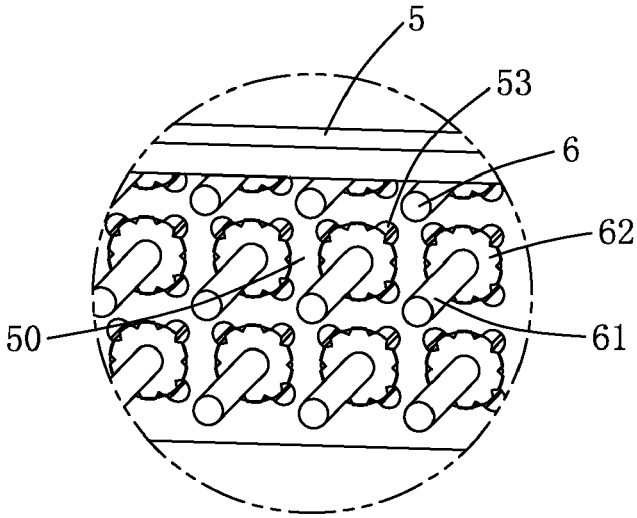
FIG. 10 is an enlarged view of the circled part in FIG. 9.
Figure 11:
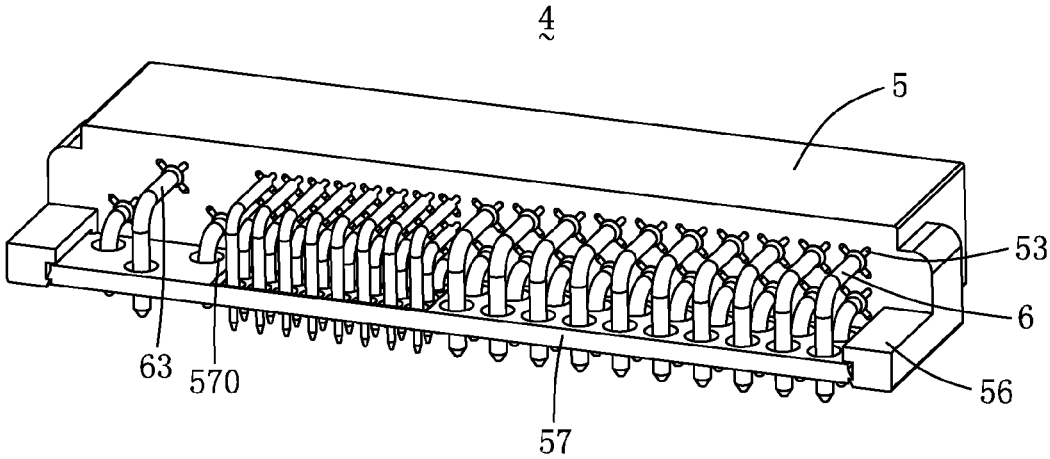
FIG. 11 is an assembled, perspective view of the second connector of FIG. 8.

Corresponding to the three groups of the first contact-receiving passages 22, the first conductive contacts 3 are also divided into three groups. From left to right, the first group of first conductive contacts 3 is arranged into two rows for low-voltage power transmission. The second group of first conductive contacts 3 is arranged into three rows for signal transmission. The third group of first conductive contacts 3 comprises three first conductive contacts 3 which are arranged into triangle relationship for high-voltage power transmission. Each first conductive contact 3 comprises a taper-shape first mating section 31 received in a front section of the first contact-receiving passage 22, a column-shape first retaining section 32 interferentially received in a middle section of the first contact-receiving passage 22, and a column-shape first mounting section 33 extending rearward from the first retaining section 32 and beyond the rear face 202 of the first base portion 21. The first mating section 31 is of hollow structure and defines a slit 310 for producing elastic deformation when receiving a second conductive contact 6 (FIG. 8).

Referring to FIGS. 8-11, the second connector 4 in accordance with a preferred embodiment of the present invention is shown. In the preferred embodiment, the second connector 4 is a plug connector. The second connector 4 comprises an elongate second insulative housing 5 and a plurality of second conductive contacts 6 assembled to the second insulative housing 5. In the preferred embodiment, the second conductive contacts 6 are divided into three groups with different sizes for different kinds of signal transmission.

In the preferred embodiment of the present invention, the second insulative housing 5 comprises a rectangular second base portion 51, opposite upper and lower walls 54 and opposite lateral walls 55 connecting with the upper and lower walls 54. The walls 54, 55 all extend forwardly from the second base portion 51. A receiving space 50 is circumscribed by the upper and lower walls 54 and the lateral walls 55 and comprises a bottom surface 510 perpendiculars to the mating direction. When the first and second connectors 1, 4 mate with each other, the mating portion 20 of the first connector 1 is received in the receiving space 50 of the second connector 4, and the front face 201 of the mating portion 20 faces to the bottom surface 510 of the receiving space 50.

Corresponding to the three groups of the second conductive contacts 6, the second base portion 51 defines a plurality second contact-receiving passages 52 with three different sizes penetrating through the second base portion 51 along the mating direction. The first group of the second contact-receiving passages 52 communicates with the receiving space 50 and is arranged in two rows. The second group of the second contact-receiving passages 52 communicates with the receiving space 50 and is arranged in three rows. The third group of the second contact-receiving passages 52 communicates with the receiving space 50 and is arranged in triangle relationship.

Each second contact-receiving passage 52 defines two pairs of arc-shape second heat-radiating passages 53 communicating therewith. The second heat-radiating passages 53 penetrate through the second insulative housing 5 along the mating direction and are recessed outwardly from inner circumferential surface of each second contact-receiving passage 52. The two pairs of second heat-radiating passages 53 are arranged symmetrically relative to the second contact-receiving passage 52 for radiating heat evenly. In a surface perpendicular to the mating direction, the imaginary lines from the two pairs of the second heat-radiating passages 53 to a center point of the second contact-receiving passage 52 form a crisscross shape. Of course, in alternative embodiments, at least one second heat-radiating passage 53 can achieve the object of the present invention and the shape of the second heat-radiating passage 53 is not only restricted to arc shape.

A pair of supporting portions 56 respectively extend rearward from lower section of opposite lateral ends of the second base portion 51 and each defines a guiding slot 560 recessed outwardly from inner surface thereof. A flat spacer 57 is assembled to the supporting portions 56 via sliding along the pair of guiding slots 560. Corresponding to the second contact-receiving passages 52 of the second insulative housing 5, the spacer 57 also defines a plurality of spacing holes 570 with different diameters for permitting the second mounting sections 63 of the second conductive contacts 6 penetrating therethrough. Corresponding to the V-shape aligning slots 203 of the first insulative housing 2, a pair of V-shape aligning bars 550 is formed on the outer sides of the lateral walls 55 of the second insulative housing 5 and respectively locates at different heights. The pair of aligning bars 550 slides along and is guided by the pair of aligning slots 203 for guiding the second connector 4 to mate with the first connector 1 properly.

According to the three groups of the first conductive contacts 3, the second conductive contacts 6 are also divided into three groups. The first group of the second conductive contacts 6 is arranged into two rows for low voltage power transmission. The second group of the second conductive contacts 6 is arranged into three rows for signal transmission. The third group of the second conductive contacts 6 comprises three second conductive contacts 6 arranged in triangle relationship for high voltage power transmission. Each second conductive contact 6 comprises a column-shape second mating section 61 exposed in the receiving space 50, a second retaining section 62 extending from the second mating section 61 and interferentially received in the second contact-receiving passage 52, and a second mounting section 63 bending downwardly from the second retaining section 62. The diameter of the second retaining section 62 is larger than those of the second mating section 61 and the second mounting section 63. A plurality of slits (not labeled) is slotted on the outer circumferential surface of the second retaining section 62 for increasing the retaining force between the second conductive contact 6 and the second contact-receiving passage 52 of the second insulative housing 5.

Figure 12:
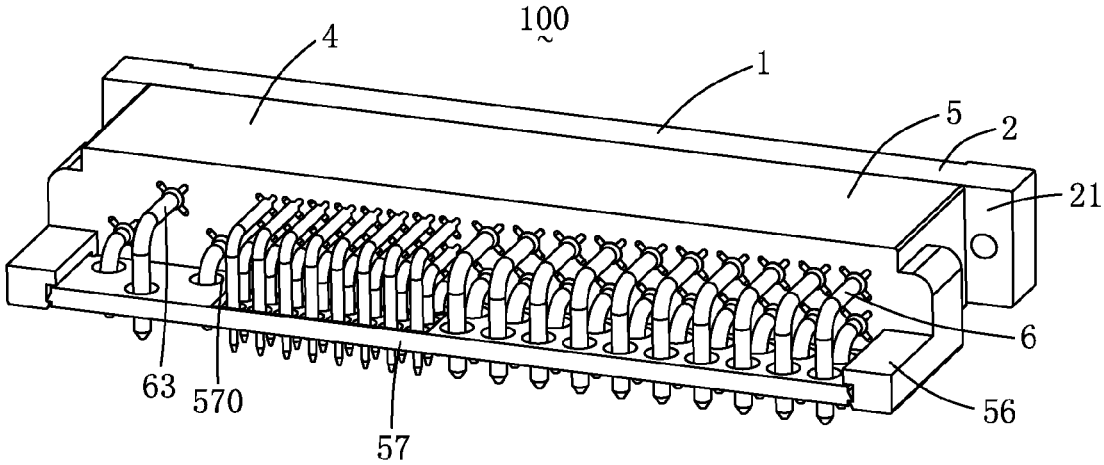
FIG. 12 is an assembled, perspective view of an electrical connector assembly in accordance with the present invention.
Figure 13:
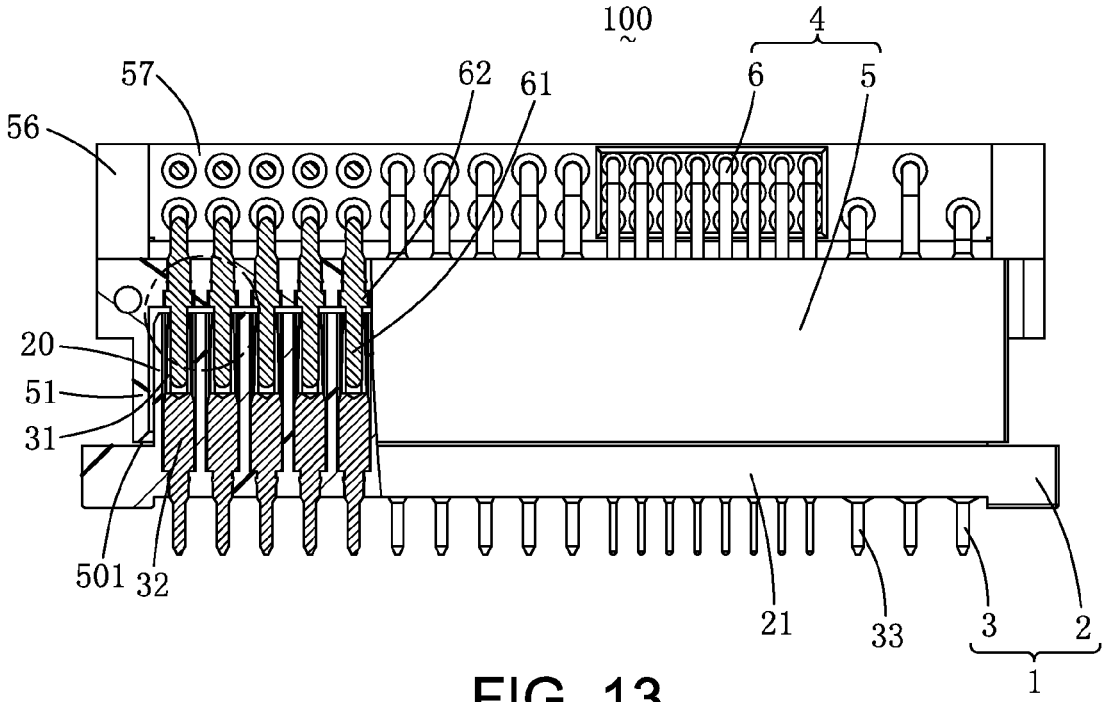
FIG. 13 is an assembled, perspective view of the electrical connector assembly viewed from another aspect with partially cross-sectional view for clear illustration.
Figure 14:
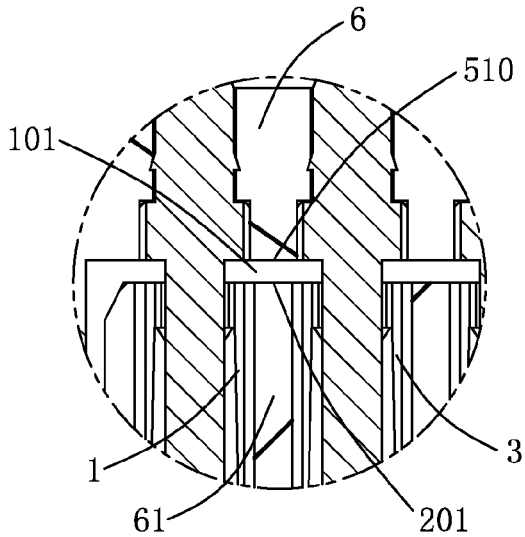
FIG. 14 is an enlarged view of a circled part in FIG. 13.

Please refer to FIGS. 12-14, the heat radiation of an electrical connector assembly 100 in accordance with the present invention formed by the mated first and second connectors 1, 4 is illustrated. It should be pointed out that the first and second connectors 1, 4 are the electrical connectors in accordance with the present invention. After mated, the mating portion 20 of the first insulative housing 2 of the first connector 1 together with the first mating sections 31 of the first conductive contacts 3 is received in the receiving space 50 of the second connector 4. The column-shape second mating sections 63 of the second conductive contacts 6 respectively insert into the hollow first mating sections 31 of the first conductive contacts 3 to form electrical connection therebetween.

Please refer to FIG. 14, after mated, the front face 201 of the first insulative housing 2 faces to the bottom surface 510 of the receiving space 50 of the second insulative housing 5, that means that there is a distance between the front face 201 and the bottom surface 510, this space forms a heat-radiating channel 101. The heat-radiating channel 101 communicates with the first and second heat-radiating passages 23, 53 for radiating heat produced by the first and second conductive contacts 3, 6 out of the first and second insulative housings 2, 5 more effectively. To form the heat-radiating channel 101, the length of the second insulative housing 5 along the mating direction can be lengthened, the length of the mating portion 20 of the first insulative housing 2 along the mating direction can be reduced, or the depth of the receiving space 50 along the mating direction can be lengthened.

Therefore, when the mated first and second conductive contacts 3, 6 generate heat, heat can be radiated out of the first and second insulative housings 2, 5 via flowing through the first and second heat-radiating passages 23, 53. The existence of the heat-radiating channel 101 and the first and second heat-radiating passages 23, 53 enhances the heat radiation effect, reduces the temperature of the first and second insulative housings 2, 5 and the first and second conductive contacts 3, 6, thus prevents the first and second insulative housings 2, 5 and the first and second conductive contacts 3, 6 from producing different kinds of problems, but also assuring rigidity of the first and second insulative housings 2, 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector adapted for electrically connecting with a complementary connector, comprising:

an insulative housing defining a mating direction and at least one contact-receiving passage extending along said mating direction, and at least one heat-radiating passage penetrating therethrough and communicating with said at least one contact-receiving passage; and at least one conductive contact received in said at least one contact-receiving passage adapted for electrically connecting with conductive contact of the complementary connector and generating heat, the at least one conductive contact comprising a mating section adapted for electrically connecting with corresponding conductive contact of the complementary connector, a retaining section extending from the mating section and interferentially engaged with the at least one contact-receiving passage, and a mounting section extending from the retaining section; and wherein the heat generated by the conductive contacts is capable of being radiated out of the insulative housing through the at least one heat-radiating passage.

2. The electrical connector as claimed in claim 1, wherein said insulative housing defines a pair of heat-radiating passages in the at least one contact-receiving passage, and wherein the pair of heat-radiating passages are arranged symmetrically in the inner circumferential surface of the at least one contact-receiving passage.

3. The electrical connector as claimed in claim 1, wherein the insulative housing defines two pairs of heat-radiating passages symmetrically arranged in the inner circumferential surface of the at least one contact-receiving passage, and wherein the imaginary lines in a surface perpendicular to said mating direction from the heat-radiating passages to the center point of at least one contact-receiving passage form a crisscross shape.

4. The electrical connector as claimed in claim 1, wherein the electrical connector comprise at least two kinds of power contacts for power transmission with different voltages.

5. The electrical connector as claimed in claim 1, wherein the electrical connector comprises at least one signal contact for signal transmission and at least one power contact for power transmission.

6. The electrical connector as claimed in claim 1, wherein said mating section of the at least one conductive contact is of column-shape.

7. The electrical connector as claimed in claim 1, wherein said retaining section of the at least one conductive contact is of column-shape with slits slotted on the circumferential surface thereof.

8. The electrical connector as claimed in claim 1, wherein the insulative housing comprises a base portion and a mating portion extending forwardly from the base portion, and wherein said at least one contact-receiving passage and at least one heat-radiating passage penetrate through both the base portion and the mating portion.

9. The electrical connector as claimed in claim 1, wherein the insulative housing comprises a receiving space circumscribed by opposite upper and lower walls and opposite lateral walls, and wherein the mating section of said at least one contact is exposed into the receiving space.

10. The electrical connector as claimed in claim 9, wherein the insulative housing forms a pair of supporting portions extending rearward from rear and lower ends of the pair of lateral walls and spaced from each other.

11. The electrical connector as claimed in claim 10, further comprising a spacer assembled to the insulative housing, and wherein the pair of supporting portions each defines a guiding slot, and the spacer is assembled to the pair of supporting portions by sliding along the pair of guiding slots.

12. An electrical connector assembly comprising:

a first connector defining a mating direction and comprising:

a first insulative housing defining at least one first contact-receiving passage penetrating through the first insulative housing along said mating direction; and at least one first conductive contact received in the at least one first contact-receiving passage of the first insulative housing;

a second connector comprising:

a second insulative housing defining at least one second contact-receiving passage penetrating through the second insulative housing along said mating direction; and at least one second conductive contact received in the at least one second contact-receiving passage of the second insulative housing and electrically connecting with the at least one first conducive contact; and wherein at least one heat-radiating passage penetrating through at least one of the first insulative housing and the second insulative housing along said mating direction and communicating with at least one of the at least one first contact-receiving passage and the at least one second contact-receiving passage; and wherein the heat generated by the first and second conductive contacts is capable of being radiated out of the first and second insulative housings via flowing through the at least one heat-radiating passage.

13. The electrical connector assembly as claimed in claim 12, wherein the first insulative housing defines a first heat-radiating passage penetrating therethrough, and wherein the first heat-radiating passage communicates with the at least one first contact-receiving passage.

14. The electrical connector assembly as claimed in claim 13, wherein the second insulative housing defines a second heat-radiating passage penetrating therethrough, and wherein the second heat-radiating passage communicates with the at least one second contact-receiving passage.

15. The electrical connector assembly as claimed in claim 14, wherein the first heat-radiating passage communicates with and aligns with the second heat-radiating passage along said mating direction.

16. The electrical connector assembly as claimed in claim 12, wherein the first insulative housing defines at least a pair of heat-radiating passages symmetrically arranged in inner circumferential surface of the at least one first contact-receiving passage, and wherein the second insulative housing defines at least a pair of heat-radiating passages symmetrically arranged in inner circumferential surface of the at least one second contact-receiving passage.

17. The electrical connector assembly as claimed in claim 12, wherein the first insulative housing comprises a mating portion defining a front face, and the second insulative housing defines a receiving space receiving said mating portion and defining a bottom surface perpendicular to said mating direction, and wherein a heat-radiating channel is formed between the front face and the bottom face and communicates with said at least one heat-radiating passage.

18. The electrical connector assembly as claimed in claim 12, wherein each of the first and second conductive contacts comprises a retaining section retained in the first and second insulative housings, a column-shape mating section extending from the retaining section.

19. The electrical connector assembly as claimed in claim 12, wherein the at least one first conductive contact and the at least one second conductive contact are power contacts for power transmission.

20. The electrical connector assembly as claimed in claim 12, wherein the first insulative housing defines a pair of aligning slots extending along said mating direction and locating at different heights, and wherein the second insulative housing forms a pair of aligning bars locating at different heights and capable of sliding along said pair of aligning slots of the first insulative housing.

* * * * *